US006655442B2

(12) United States Patent
Snyder

(10) Patent No.: US 6,655,442 B2
(45) Date of Patent: Dec. 2, 2003

(54) SECTIONAL DOOR WITH EXTRUDED PANEL MEMBERS

(75) Inventor: Ronald P. Snyder, Peosta, IA (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 0 days.

(21) Appl. No.: 09/956,620

(22) Filed: Sep. 19, 2001

(65) Prior Publication Data

US 2003/0051827 A1 Mar. 20, 2003

(51) Int. Cl.[7] ..... E05D 15/06
(52) U.S. Cl. ..... 160/201; 160/232
(58) Field of Search ..... 160/201, 232, 160/236, 229.1, 133, 40

(56) References Cited

U.S. PATENT DOCUMENTS

| | | | | | |
|---|---|---|---|---|---|
| 2,926,729 | A | * | 3/1960 | Zanini | 160/236 |
| 2,951,533 | A | * | 9/1960 | Lucas et al. | 160/40 |
| 3,247,637 | A | | 4/1966 | Robertson | 52/588 |
| 3,302,690 | A | * | 2/1967 | Hurd | 160/40 |
| 3,980,123 | A | | 9/1976 | Vago | 160/201 |
| 4,432,591 | A | | 2/1984 | Rinkewich | 312/297 |
| 4,569,383 | A | | 2/1986 | Wentzel | 160/201 |
| 4,924,932 | A | | 5/1990 | Esnault | 160/201 |
| 5,060,711 | A | * | 10/1991 | Fimbell | 160/229.1 |
| 5,170,832 | A | | 12/1992 | Wagner | 160/201 |
| 5,265,663 | A | * | 11/1993 | Munekata et al. | 160/235 X |
| 5,445,206 | A | | 8/1995 | Shepard | 160/201 |
| 5,445,208 | A | | 8/1995 | Shaner | 160/232 |
| 5,553,651 | A | | 9/1996 | Olsen | 160/235 |
| 5,555,923 | A | | 9/1996 | Leist | 160/229.1 |
| 5,718,276 | A | | 2/1998 | Rekret | 160/201 |
| 5,915,446 | A | | 6/1999 | De Zen | 160/235 |
| 6,041,846 | A | | 3/2000 | Langlois | 160/201 |
| 6,041,847 | A | * | 3/2000 | Lai | 160/236 |
| 6,098,696 | A | | 8/2000 | Styra | 160/201 |

FOREIGN PATENT DOCUMENTS

| | | | |
|---|---|---|---|
| WO | 90/14486 | 11/1990 | E05D/15/24 |

OTHER PUBLICATIONS

International Search Report from PCT/US02/29655.

* cited by examiner

*Primary Examiner*—David M. Purol
(74) *Attorney, Agent, or Firm*—Marshall, Gerstein & Borun LLP

(57) ABSTRACT

A sectional door includes a series of track-guided pivotal door panels, wherein at least one of the door panels comprises several interlocked panel members. The panel members are of various widths so they can be assembled in different combinations to create a door panel of a desired total width. The panel members can be extrusions that are readily cut to length to match doorways of various widths. The ability to readily provide a panel in various widths and lengths makes such a door panel particularly useful as a replacement panel whose size needs to match that of existing door panels. In some cases, one or more panel members can be transparent to create a door panel with an integral window.

45 Claims, 4 Drawing Sheets

FIG. 2
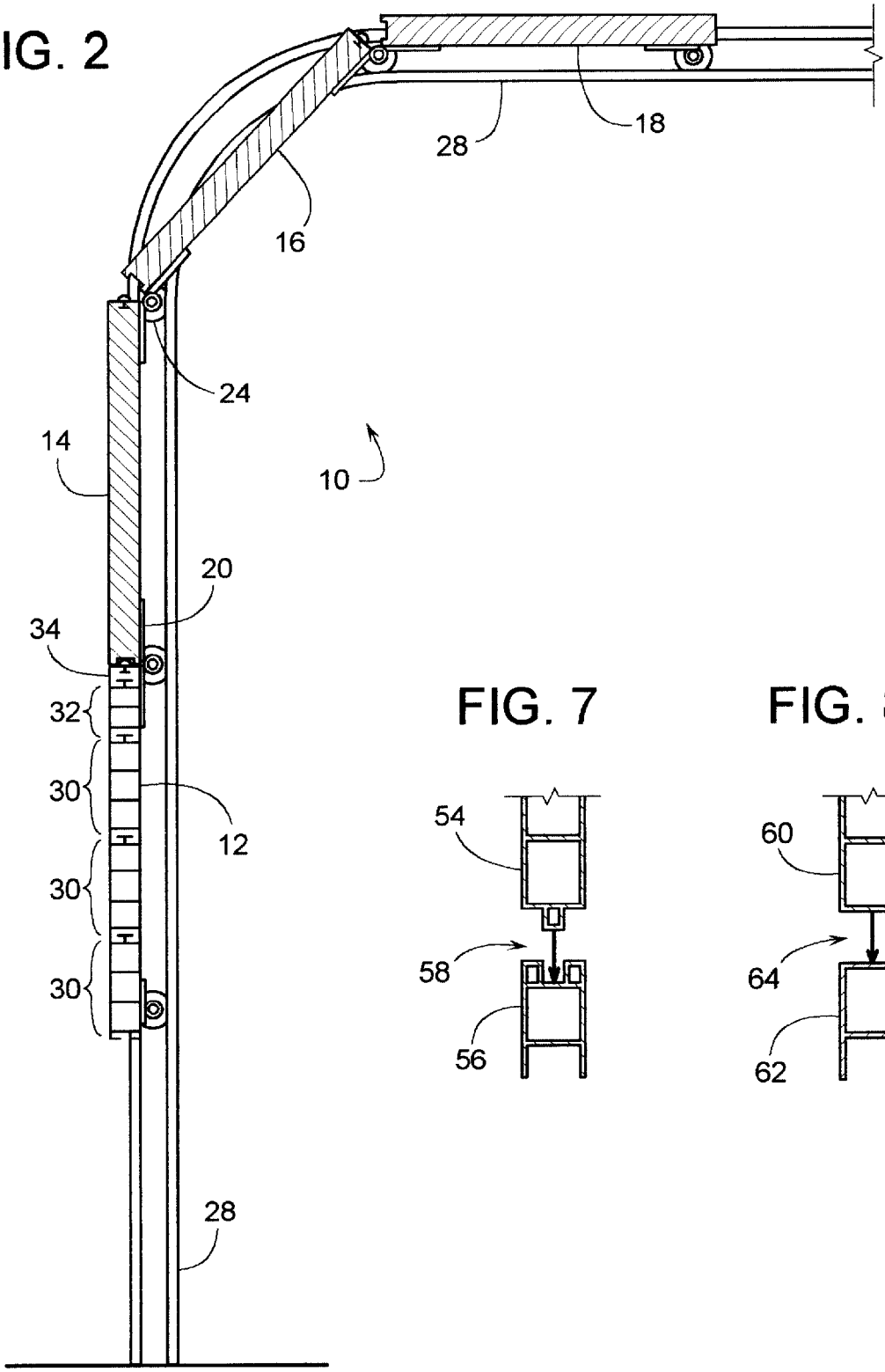
FIG. 7
FIG. 8
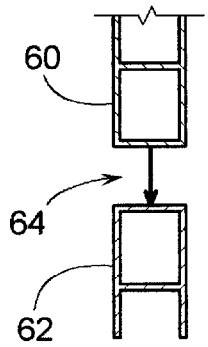

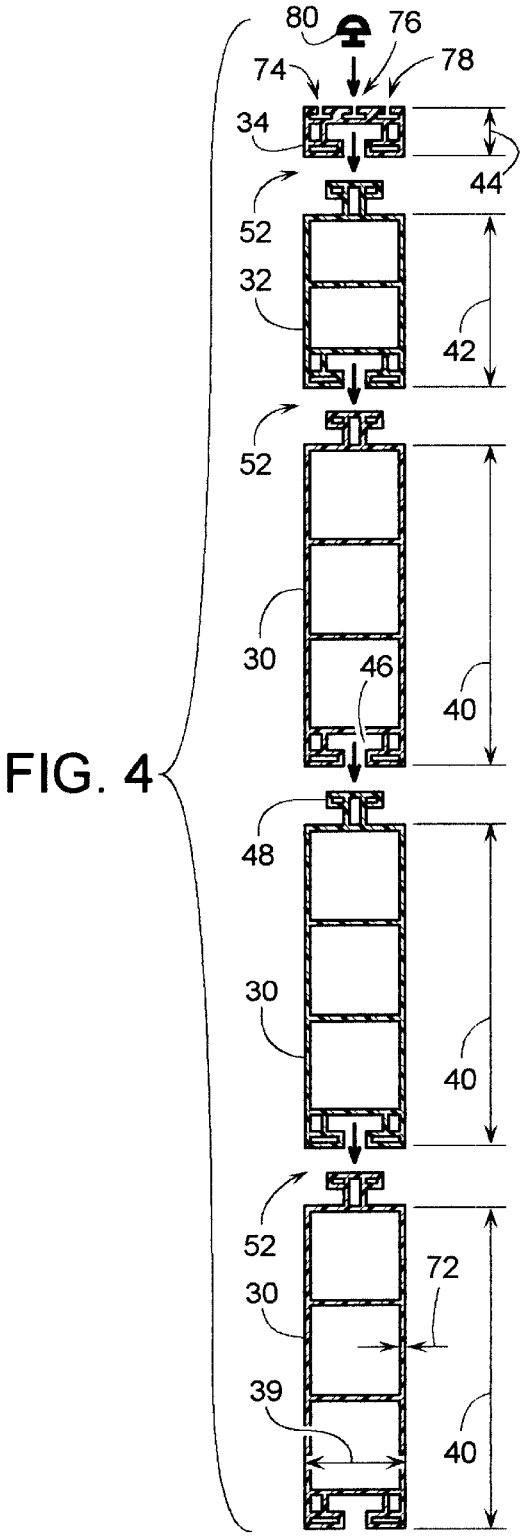
FIG. 4
FIG. 5
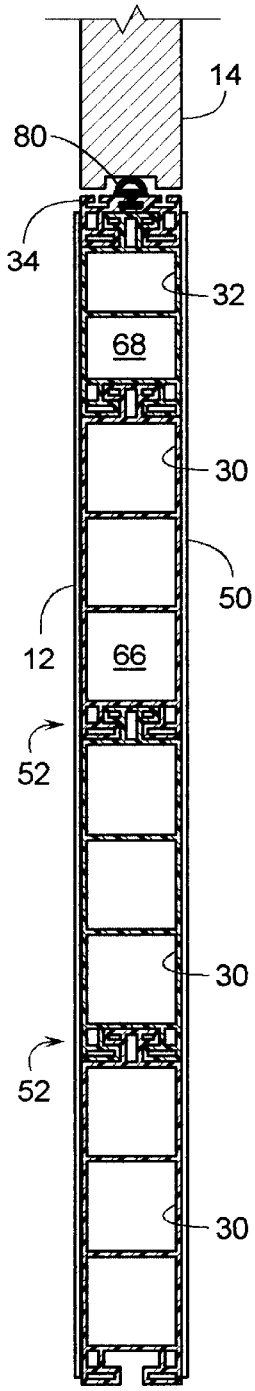
FIG. 6
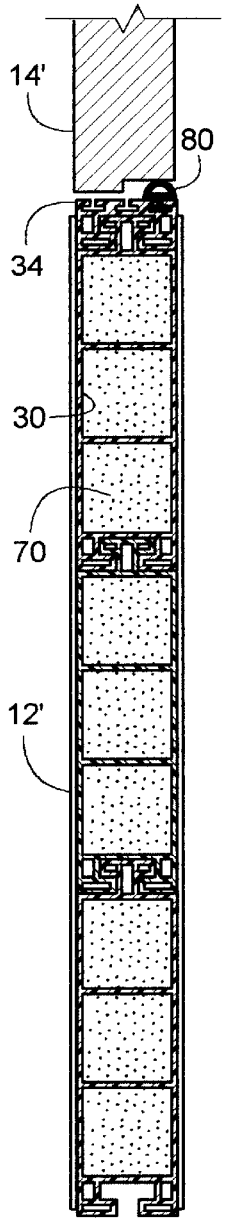

SECTIONAL DOOR WITH EXTRUDED PANEL MEMBERS

BACKGROUND OF THE INVENTION

1. Field of the Invention

The subject invention generally pertains to sectional doors and more specifically to door panel with extruded panel members.

2. Description of Related Art

A sectional door typically includes a series of panels whose adjacent horizontal edges are each pivotally connected by a row of hinges. As the door opens or closes, the door panels travel along two lateral tracks that in one configuration curve between horizontal and vertical. To close the door, the tracks guide the panels to a vertical position. When the door opens, the hinges allow the panels to curve around onto horizontal sections of the tracks, where the door panels store horizontally overhead. In other configurations, the sectional door maintains a generally vertical, planar configuration and is stored more directly above the doorway. Such doors, regardless of their configuration, can be powered up or down or can be manually operated. To ease the operation of the door, a torsion spring is often used to offset the weight of the door panels. Sectional doors are commonly used as residential garage doors; however, they are also often used in warehouses and other industrial buildings.

When used in high-traffic industrial applications, sectional doors are very susceptible to being struck by large trucks, trailers, forklifts and other vehicles passing through the doorway. Collisions are often caused by a door's torsion spring becoming weak with age or not being properly preloaded, which can allow a door to droop into the doorway by not opening fully. Consequently, an upper edge of a vehicle may catch the lowest panel of the door, which often breaks or destroys just that panel.

To avoid having to repeatedly replace the lowest panel with an identical one, a more impact-resistant panel can be used as a replacement, such as a panel that is tougher and more flexible. However, to do so, the replacement panel should be about the same size as the one being replaced. The replacement panel should also have a seal member whose shape and location is suitable for sealing against an existing door panel. Providing such a replacement door panel can be difficult to do, because of the different types of seals and the wide range of existing door panel sizes. A panel design whose length, width or seal configuration is not readily altered would generally require a large inventory of panels to meet the requirements of numerous door applications.

Some door panels have metal frames with sheet metal skins. Such construction features can make a door panel difficult to shorten or lengthen (along the width of the doorway) to match the existing panels. Such features also make it difficult to change a door panel's width (vertical dimension when the door is closed).

Other door panels may perhaps be extruded, such as those of U.S. Pat. Nos. 5,718,276; 5,445,206; 5,170,832; 4,979,553; 4,924,932; 4,432,591 and 3,247,637. Extruded panels may be relatively easy to cut to length (i.e., doorway width); however, their width and seal geometry is generally fixed. It's conceivable that interconnecting a series of relatively narrow panels could create doors having various accumulated heights. However, with current designs, flexing between each adjacent panel means each individual panel may need to have its own means for guiding itself along the track. Since each additional guide member contributes drag to the door's movement, a door with numerous narrow panels may be more difficult to open and close than a door with fewer panels. The problem of drag not only applies to doors whose bottom panel is replaced, but also applies to new door construction.

Consequently, there is a need to be able to manufacture replacement door panels as well as entire doors for doorways of various width and height, and to be able to do so without having to manufacture and stock numerous door panels of various sizes and seal geometries.

SUMMARY OF THE INVENTION

In some embodiments, a sectional door is provided with several panel members with at least one panel member having more freedom to pivot relative to a first adjacent panel or panel member than it is able to pivot relative to a second adjacent panel member.

In some embodiments, one panel member is substantially fixed to a first adjacent panel member, but is able to pivot relative to a second adjacent panel or panel member.

In some embodiments, a door panel comprises a series of extruded panel members.

In some embodiments, a sectional door is provided with a door panel comprising several panel members of various widths.

In some embodiments, a door panel is comprised of several interlocking panel members.

In some embodiments, a door panel member is provided with a hollow interior, so the panel can be readily extruded.

In some embodiments, a door panel member is provided with a hollow interior, so the panel can be filled with thermal insulation.

In some embodiments, a seal member can be attached to a door panel member at alternate locations, so the resulting panel can serve as a replacement panel for existing doors of various seal designs.

In some embodiments, a door panel comprises a set of interlocking panel members that are reinforced by two end caps, wherein the end caps facilitate the mounting of various door hardware.

In some embodiments, a door panel is made of door panel members of plastic for flexibility and includes a hinge made of steel for strength.

In some embodiments, a sectional door includes a door panel of a transparency ranging from transparent to opaque.

BRIEF DESCRIPTION OF THE DRAWINGS

FIG. 2 is a cross-sectional view taken along line 2—2 of FIG. 1.

FIG. 4 is a cross-sectional end view in an exploded arrangement showing various parts of a door panel used in the door of FIG. 1.

FIG. 5 is a cross-sectional end view of the door panel of FIG. 4, but shown assembled and connected to an adjacent door panel having a tongue and groove seal design.

FIG. 6 is a cross-sectional end view similar to FIG. 5, but showing a door panel of a different assembled width and with the door panel connected to an adjacent door panel having a shiplap seal design.

FIG. 7 is a cross-sectional end view of an alternate embodiment of two adjoining panel members.

FIG. 8 is similar to FIG. 7, but showing yet another embodiment of two adjoining panel members.

DESCRIPTION OF THE PREFERRED EMBODIMENT

Figure 1:
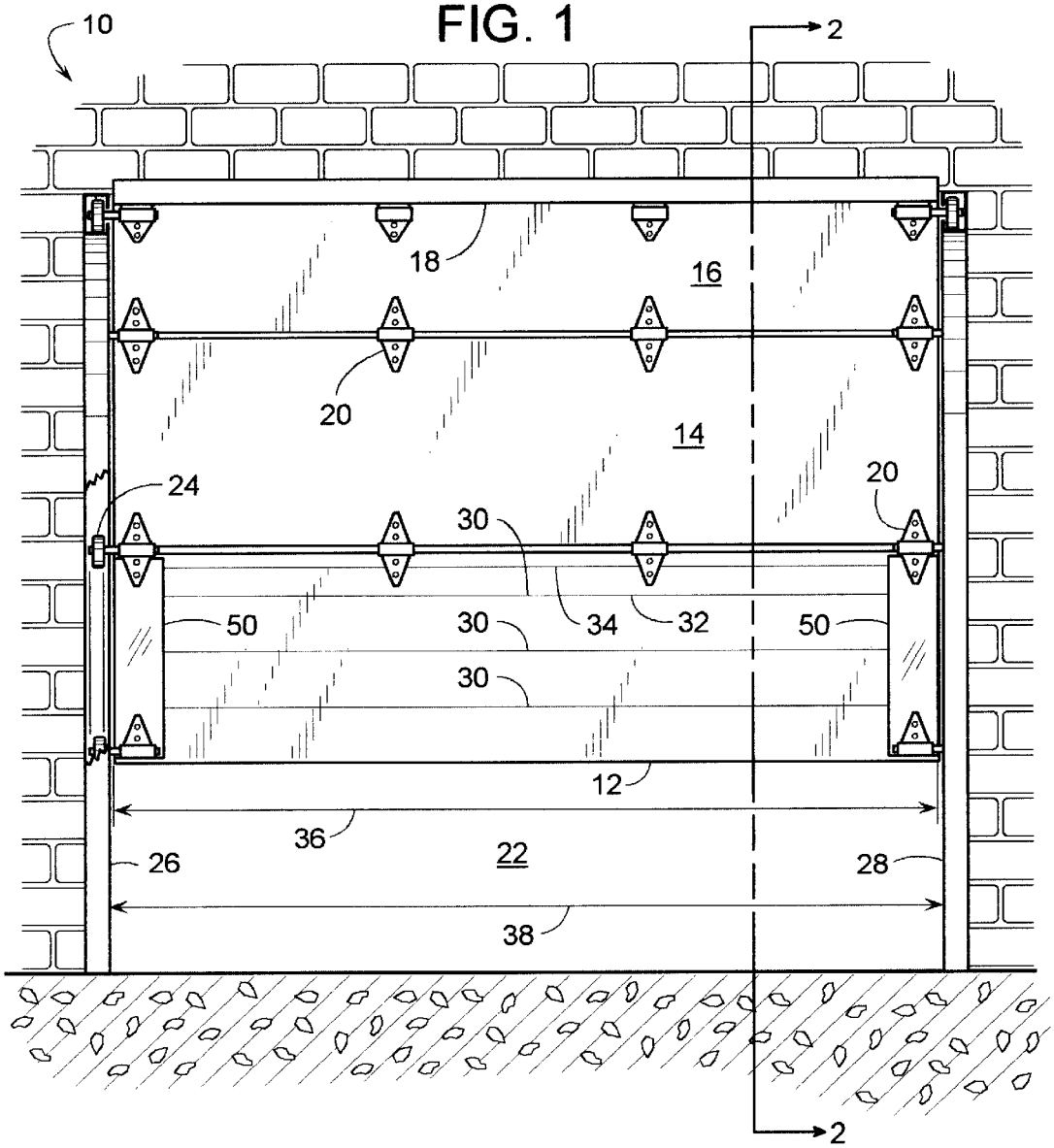
FIG. 1 is a front view of one embodiment of an overhead-storing sectional door in a partially open position, with the door being viewed from inside a building and looking out.

A sectional door 10, shown partially open in FIGS. 1 and 2, includes a series of door panels 12, 14, 16 and 18 that are interconnected along their adjacent horizontal edges by hinges 20. In this description, the term, "panel" describes one of typically four or five sectional door components, each of which is generally planar and hingedly interconnected to panels above and below, except for the top and bottom panels. As door 10 opens or closes relative to a doorway 22, guide members, such as rollers 24, guide the movement of the panels along two lateral tracks 26 and 28. In this example, tracks 26 and 28 curve between horizontal and vertical; however, it is well within the scope of the invention to have tracks 26 and 28 run generally linearly or only curve slightly, so that when the door opens, the door panels move above doorway 22, but remain in a generally vertical or slightly angled orientation. To close door 10, the vertical sections of tracks 26 and 28 guide the panels to a vertical position across doorway 22, as indicated by the positions of panels 12 and 14. When door 10 opens, hinges 20 allow the panels to curve around onto the horizontal sections of tracks 26 and 28, where the door panels store horizontally overhead, as indicated by the position of panel 18.

The actual structure of panels 12, 14, 16 and 18 can vary from one door to another, vary among panels of the same door, or be the same for each panel of the same door and still remain well within the scope of the invention. However, many of the door panel embodiments are especially useful in retrofit applications where a new panel replaces the lowest panel of a door whose original panels are not as impact resistant as the new one. So, a preferred embodiment will be described with reference to door 10 whose lowest panel 12 comprises a set of interconnected panel members 30, 32 and 34 that are relatively tough and impact resistant.

Panel members 30, 32 and 34 can be extruded of PVC in different shapes and sizes, as shown generally in FIGS. 4–6. The panel members can be cut to a particular length 36 that is appropriate for a width 38 of doorway 22 (see FIG. 1), or two or more panel members can be laid end-to-end to create any desired length for other doorways (e.g., see panels 84 and 86 of FIG. 9). A thickness 39 of each of the panel members is generally the same; however, the exposed width of a panel member can vary from one panel member to the next. When referring to a panel member, the term "width" refers to a dimension of the panel member measured along a direction generally parallel to the direction the panel member translates as the door opens or closes. For example, when the door is closed with a panel member lying generally along a vertical plane, the width of the panel member is measured vertically. For door panel 12, the width of panel members 30, 32 and 34 is approximately 6 inches, 3 inches, and 1 inch, as indicated by dimensions 40, 42 and 44, respectively (see FIG. 4). This allows the panel members to be interconnected in various combinations to create door panels of various total widths. In FIG. 5, for example, panel members 30, 32 and 34 provide door panel 12 with a total width of about 22 inches (1+3+6+6+6). In FIG. 6, panel members 30 and 34 provide a door panel 12' whose total width is 19 inches (1+6+6+6).

Figure 3:
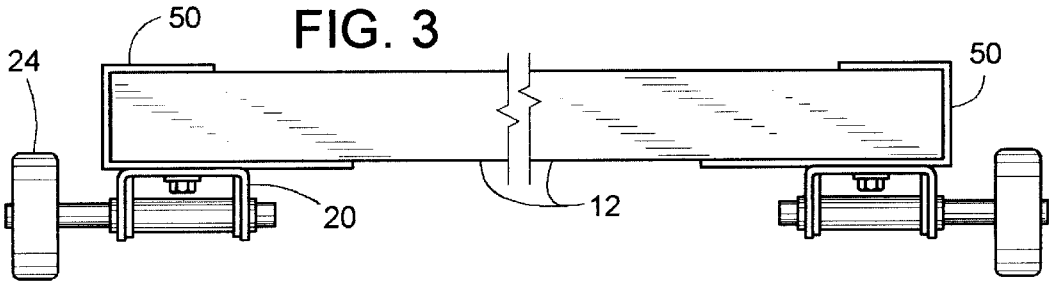
FIG. 3 is a top view of a door panel of in FIG. 1.

To interconnect the panel members, each panel member 30, 32 and 34 includes a T-slot 46 adapted to receive a mating protrusion 48 of an adjacent panel member by sliding protrusion 48 lengthwise into slot 46. T-slot 46 and protrusion 48 can be extruded along with the rest of the panel member to comprise a unitary piece. In some cases, sheet metal end caps 50 (see FIG. 3) can be fastened to each end of door panel 12 to provide panel 12 with greater rigidity and provide a strong surface to which rollers 24 and metal hinges 20 can be attached. Although, T-shaped slots and protrusions are preferred, because they provide the panel members with an interlocking connection 52, other panel-to-panel interfaces are also well within the scope of the invention. For example, in some embodiments, a tongue and groove connection 58 provides an interface between adjacent panels 54 and 56, as shown in FIG. 7. In another embodiment, a butt connection 64 provides an interface between panels 60 and 62, as shown in FIG. 8. With connections 58 and 64, however, additional hardware, such as end caps 50, would be needed to hold the panels together. It should be noted that the top surface of panel member 34 may be generally flat to facilitate a pivotal connection to the adjacent panel 14 or 14'.

Panel members 30 and 32 can have a hollow interior 66 and 68, as shown in FIG. 5, or its interior can be filled with a thermal insulating filler material 70, such as foam, as shown in FIG. 6. Other portions of members 30, 32 and 34 are also hollow to provide a panel member with a relatively thin and substantially uniform material thickness 72. This not only reduces the amount of material required to make a panel member, but also facilitates the use of a conventional plastic extrusion process, wherein softened extruded material is able to solidify at a quick, uniform rate.

To enable door panel 12 to seal against various adjoining panels, such as panel 14 of FIG. 5 or panel 14' of FIG. 6, panel member 12 includes several slots 74, 76 and 78 into which a compliant vinyl seal member 80 can be selectively installed to suit the geometry of the adjoining panel. Seal member 80 installed in slot 76 fits the tongue and groove seal geometry of panel 14, and seal member 80 installed in slot 78 accommodates the shiplap seal design of panel 14'.

Figure 9:
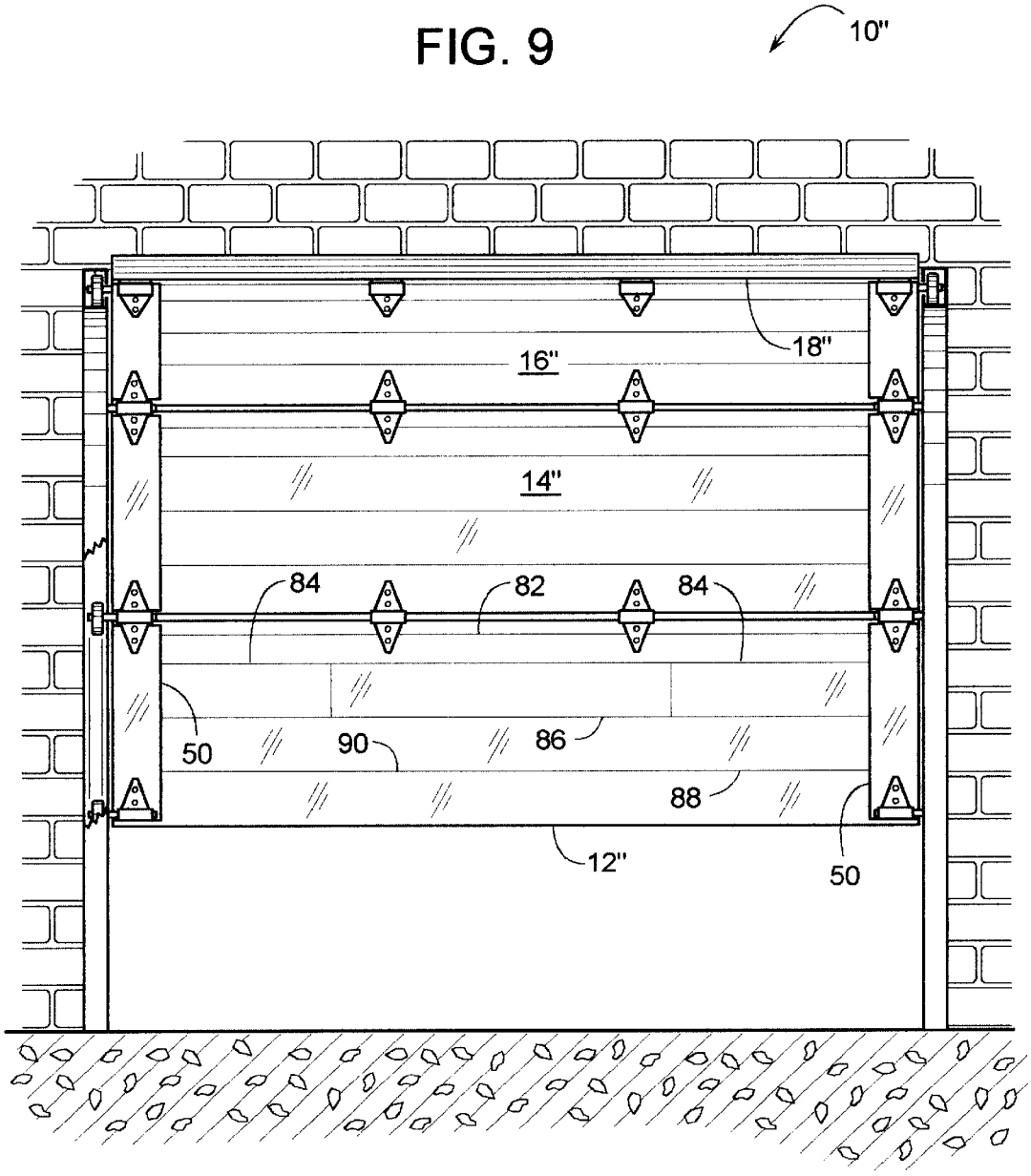
FIG. 9 is similar to FIG. 1, but showing another embodiment of a door panel.

In some cases, a door panel may include one or more panel members with different levels of transparency. In FIG. 9, for example, a door 10" includes a door panel 12" comprising opaque panel members 82 and 84, transparent panel members 86 and 88, and a translucent panel member 90. Transparent panels 86 and 88 serve as windows, and translucent panel 90 allows some light to pass, but provides more privacy than what is provided by panels 86 and 88. For door 10", panels 14", 16" and 18" are of a construction similar to that of panel 12 of door 10.

The door panel thus described, formed from interconnected door panel members, may advantageously be used as a replacement panel for the bottom panel of a sectional door. At the same time, the resulting door panel may be used to replace any other door panel. Finally, the entire door may be formed of such panels.

Although the invention is described with reference to a preferred embodiment, it should be appreciated by those skilled in the art that various modifications are well within the scope of the invention. Therefore, the scope of the invention is to be determined by reference to the claims that follow.

I claim:

1. A door panel attachable to an adjacent panel of a sectional door, the door panel comprising:

a first panel member adapted to be pivotally attached to the adjacent panel; and a second panel member, wherein the first panel member and the second panel member define an interlocking connection that restricts panel-to-panel separation of the second panel member and the first panel member within a plane of the doorway and that allows the second panel member to move slidably across the doorway.

2. The door panel of claim 1, wherein the interface is an interlocking connection between the first panel member and the second panel member.

3. The door panel of claim 2, wherein the interlocking connection comprises a first member that interlocks with a second member, wherein the first member and the first panel member comprise a first unitary piece and the second member and the second panel member comprising a second unitary piece.

4. The door panel of claim 1, wherein the first panel member is substantially fixed relative to the second panel member.

5. The door panel of claim 1, wherein the first panel member and the second panel member each have a length, width and thickness, with the first panel member and the second panel member being of different widths.

6. The door panel of claim 1, further comprising a third panel member coupled to the second panel member, wherein movement between the third panel member and the second panel member is more limited than movement between the first panel member and the adjacent panel of the sectional door.

7. The door panel of claim 6, wherein the first panel member, the second panel member and the third panel member each have a unique width relative to each other.

8. The door panel of claim 1, wherein at least one of the first panel member and the second panel member defines a hollow interior.

9. The door panel of claim 1, wherein at least one of the first panel member and the second panel member defines an interior that contains a thermal insulating filler material.

10. The door panel of claim 1, wherein the first panel member is of a shape and a material that can be extruded.

11. The door panel of claim 1, further comprising a seal member adapted to engage the adjacent panel of the sectional door, wherein the first panel member defines a first slot and a second slot to provide alternate locations in which to selectively insert the seal member.

12. The door panel of claim 1, further comprising two end caps attached to opposite ends of the first panel member and the second panel member, wherein the end caps help hold the first panel member substantially fixed to the second panel member.

13. The door panel of claim 12, further comprising two rollers attached to the two end caps.

14. The door panel of claim 1, further comprising a hinge fastened to the first panel member and being adapted to fasten to the adjacent panel.

15. The door panel of claim 13, wherein the first panel member is made of plastic and the hinge is made of metal.

16. The door panel of claim 1, wherein at least one of the first panel member and the second panel member is transparent.

17. The door panel of claim 1, wherein only one of the first panel member and the second panel member is transparent.

18. The door panel of claim 1, wherein at least one of the first panel member and the second panel member is translucent.

19. A door panel attachable to an adjacent panel of a sectional door, the door panel comprising:

a first panel member adapted to be pivotally attached to the adjacent panel along a pivotal axis; and a second panel member, wherein the first panel member and the second panel member define an interface therebetween that slidably connects the first panel member to the second panel member, wherein the interface provides greater panel-to-panel separation resistance of the first panel member from the second panel member perpendicular to the pivotal axis than parallel to the pivotal axis.

20. The door panel of claim 19, wherein the interface is an interlocking connection between the first panel member and the second panel member.

21. The door panel of claim 20, wherein the interlocking connection comprises a first member that interlocks with a second member, wherein the first member and the first panel member comprise a first unitary piece and the second member and the second panel member comprising a second unitary piece.

22. The door panel of claim 19, wherein the first panel member is substantially fixed relative to the second panel member.

23. The door panel of claim 19, further comprising a third panel member coupled to the second panel member, wherein movement between the third panel member and the second panel member is more limited than movement between the first panel member and the adjacent panel of the sectional door.

24. The door panel of claim 23, wherein the first panel member, the second panel member and the third panel member each have a unique width relative to each other.

25. The door panel of claim 19, wherein at least one of the first panel member and the second panel member defines a hollow interior.

26. The door panel of claim 19, wherein at least one of the first panel member and the second panel member defines an interior that contains a thermal insulating filler material.

27. The door panel of claim 19, wherein the first panel member is of a shape and a material that can be extruded.

28. The door panel of claim 19, further comprising a seal member adapted to engage the adjacent panel of the sectional door, wherein the first panel member defines a first slot and a second slot to provide alternate locations in which to selectively insert the seal member.

29. The door panel of claim 19, further comprising two end caps attached to opposite ends of the first panel member and the second panel member, wherein the end caps help hold the first panel member substantially fixed to the second panel member.

30. The door panel of claim 29, further comprising two rollers attached to the two end caps.

31. The door panel of claim 19, further comprising a hinge fastened to the first panel member and being adapted to fasten to the adjacent panel.

32. The door panel of claim 31, wherein the first panel member is made of plastic and the hinge is made of metal.

33. The door panel of claim 19, wherein at least one of the first panel member and the second panel member is transparent.

34. The door panel of claim 19, wherein only one of the first panel member and the second panel member is transparent.

35. The door panel of claim 19, wherein at least one of the first panel member and the second panel member is translucent.

36. A sectional door, comprising:

a first panel member;

an adjacent panel pivotally attached to the first panel member; and a second panel member, wherein the first panel member and the second panel member define an interlocking connection therebetween that horizontally, slidably connects the first panel member to the second panel member, and wherein the first panel member and the second panel member have the same length.

37. The sectional door of claim 36, wherein the second panel member comprises a plurality of sub-panel members that collectively have the same length as the first panel member.

38. The door panel of claim 1, wherein at least one of the first panel member and the second panel member extend across the length of the doorway.

39. The door panel of claim 1, further comprising a third panel member slidably interconnected to the first panel member and slidably interconnected to the second panel member, wherein the third panel member has a length less than that of the first panel member or the second panel member.

40. The door panel of claim 1, further comprising a third panel member slidably interconnected to the first panel member and slidably interconnected to the second panel member, wherein the third panel member has a length equal to that of the first panel member or the second panel member.

41. The door panel of claim 1, wherein the second panel member comprises a plurality of sub-panel members that are each smaller in length than the first panel member.

42. The door panel of claim 19, wherein the second panel member comprises a plurality of sub-panel members that are each smaller in length than the first panel member.

43. A door panel attachable to an adjacent panel of a sectional door, the door panel comprising:

a first panel member adapted to be pivotally attached to the adjacent panel;

a second panel member; and an end cap attached to an end of the first panel member and the second panel member, wherein the end cap holds the first panel member substantially fixed to the second panel member.

44. The door panel of claim 43, wherein the first panel member has a different length than the second panel member.

45. The door panel of claim 43, further comprising an interface between the first panel member and the second panel member, wherein movement between the first panel member and the second panel member at the interface is more restricted than movement between the first panel member and the adjacent panel.

* * * * *